US005579956A

United States Patent [19]

Seale

[11] Patent Number: 5,579,956

[45] Date of Patent: Dec. 3, 1996

[54] TUBE TAB AND METHOD OF USE

[76] Inventor: Milton A. Seale, 310 Charleston, Victoria, Tex. 77904

[21] Appl. No.: 514,775

[22] Filed: Aug. 14, 1995

[51] Int. Cl.[6] ..... B65D 35/32

[52] U.S. Cl. ..... 222/107

[58] Field of Search ..... 222/92, 95, 96, 222/97, 98, 99, 100, 101, 102, 103, 104, 105, 106, 107

[56] References Cited

U.S. PATENT DOCUMENTS

| | | | |
|---|---|---|---|
| 1,310,083 | 7/1919 | Huntoon | 222/99 |
| 1,537,010 | 5/1925 | Herschmann | 222/99 |
| 1,559,565 | 11/1925 | Farnum | 222/99 |
| 3,138,292 | 6/1964 | Hanna | 222/99 |
| 4,807,782 | 2/1989 | Meinerding et al. | 222/1 |
| 5,082,144 | 1/1992 | Sundstrom | 222/99 |
| 5,167,349 | 12/1992 | Rodder et al. | 222/107 |
| 5,344,049 | 9/1994 | MacDonald | 222/107 |
| 5,373,968 | 12/1994 | Nelson | 222/99 |

FOREIGN PATENT DOCUMENTS

| | | | |
|---|---|---|---|
| 418394 | 10/1934 | Germany | 222/99 |

*Primary Examiner*—Kevin P. Shaver
*Assistant Examiner*—Lisa Douglas
*Attorney, Agent, or Firm*—Cynthia G. Seal; Buskop Law Group

[57] ABSTRACT

In one embodiment of the present invention there is provided a disposable fastener which is adaptable to many different size tubes. The fastener comprises a creasable strip portion having dead fold properties and a tab portion. The tab portion is attached to the creasable strip portion and has a pressure sensitive adhesive on one surface. The tab portion extends from the creasable strip portion. A method for attaching a fastener of the type described above is also disclosed. There is also provided a fastener with no adhesive properties and a method for using the same with a collapsible tube.

10 Claims, 1 Drawing Sheet

TUBE TAB AND METHOD OF USE

BACKGROUND OF THE INVENTION

In one aspect of this invention relates to a fastener that may be adhesively attached to collapsible tubes such as ointments, toothpaste, glue, paints, etc. In another aspect, this invention relates to a fastener used with a collapsible tube without adhesives and a method for attaching the fastener. In another aspect, this invention relates to a method for dispensing the contents of a tube.

Current and past tube physiology has led to many different ways to get the last little bit of product out of the tube or keep the tube in a neat rolled position as the user dispenses the product. Plastic or vinyl tubes spring back to their original form when allowed and metallic based tubes tear or split if rolled too many times. A disposable tube fastening device that will keep a tube in a neat rolled position would be highly desirable.

Existing devices constructed to aid in dispensing the contents of a tube are usually very complicated or incorporate a dispensing device into the tube itself. A tube that incorporates the fastener into the closed end is not currently in use in the toothpaste and ointment industry. A tube fastening device that is disposable and easy to use would be highly sought after.

Other devices have a fixed gap width which make it difficult to use because it either fits too tight or not tight enough. A tube fastening device that conforms to any size tube would be highly desirable.

OBJECTS OF THE INVENTION

It is an object of the present invention to provide a disposable inexpensive fastener that may be used with any type of collapsible tube.

It is another object of the present invention to provide a disposable fastener with an adhesive on one surface to aid in easily attaching the fastener to a tube and a method for attaching the same.

It is yet another object of the present invention to provide a method for dispensing the contents of a tube with a disposable fastener that is inexpensive and easy to use.

SUMMARY OF THE INVENTION

In one embodiment of the present invention there is provided a disposable fastener which is adaptable to many different size tubes. The fastener comprises a creasable strip portion having dead fold properties and a tab portion. The tab portion is attached to the creasable strip portion and has a pressure sensitive adhesive on one surface. The tab portion extends from the creasable strip portion.

In another embodiment of the invention there is provided an apparatus comprising a collapsible tube and a fastener. The tube has an elongated flexible, tubular body having a first end and a second end. The first end has an opening and the second end is closed. The fastener comprises a creasable strip portion having dead fold properties and a tab portion attached to the creasable strip portion. The tab portion extends from the creasable strip portion and does not have any adhesive. The second end of the collapsible tube is closely received by the fastener. The creasable strip portion is of adequate length and strength to be folded over the collapsible tube and hold it in a rolled up position. When the contents of the tube have been exhausted, the tube and the fastener may be thrown away.

In another embodiment of the invention, there is provided a method for dispensing the contents of a collapsible tube. The tube has an elongated flexible, tubular body with an opening at one end and closed at the opposite end. The method comprises providing a collapsible tube and a fastener. The tube has an elongated flexible, tubular body. The tube has a first end and a second end, where the first end has an opening and the second end is closed. The fastener comprises a creasable strip portion having dead fold properties and a tab portion. The tab portion is attached to and extends from the creasable strip portion. In use, the fastener is positioned so that the second end of the collapsible tube is closely received by the fastener. The tab portion is folded over the second end of the tube and the second end of the tube is rolled towards the first end of the tube. The creasable strip portion is folded over the collapsible tube to hold it in a rolled up position.

In yet another embodiment of the present invention, there is provided a method for attaching a fastener to a collapsible tube. The method comprises providing a tube as described previously and a fastener. The fastener is as described previously with a pressure sensitive adhesive on a first surface. In use, the fastener is positioned so that the second end of the collapsible tube is closely received by the first surface of the fastener. The tab portion is folded over the second end of the tube and the fastener is secured to the tube by pressing on the tab portion to engage the pressure sensitive adhesive. The second end of the tube is then rolled towards the first end of the tube. The creasable strip portion is folded over the collapsible tube to hold it in a rolled up position.

DETAILED DESCRIPTION OF THE PREFERRED EMBODIMENTS

Figure 1:
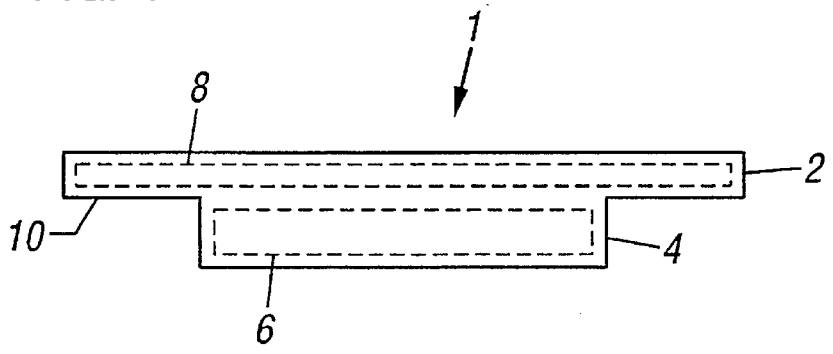
FIG. 1 is a view of one embodiment of the fastener, showing the placement of the adhesive and the bendable metal member.

In one embodiment of the present invention there is provided a fastener 1 which is adaptable to many different size tubes. As shown in FIG. 1, the fastener 1 comprises a creasable strip portion 2 having dead fold properties and a tab portion 4. The tab portion 4 is attached to the creasable strip portion 2 and has a pressure sensitive adhesive on one surface 6. The tab portion 4 extends from the creasable strip portion 2 preferably, generally normal from the longitudinal axis of the creasable strip portion 2.

In a preferred embodiment, the fastener 1 is T-shaped where the strip portion is at least one and one half times as long as the tab portion 4 and the tab portion has a width that is at least equal to a width of the strip portion 4. The creasable strip portion 2 is elongated, has a longitudinal axis, and preferably comprises a bendable metal member 8 sheathed in a paper member 10. Preferably, the tab portion 4 is formed by a portion of the paper member 10. The strip portion is creasable across its longitudinal axis and the bendable metal member 8 comprises a metal strip. The strip portion is at least 5 centimeters in length. The tab portion 4 has a longitudinal axis positioned generally parallel to the longitudinal axis of the strip portion and is preferably at least 3 centimeters in length and at least 1 centimeter in width.

Figure 2:
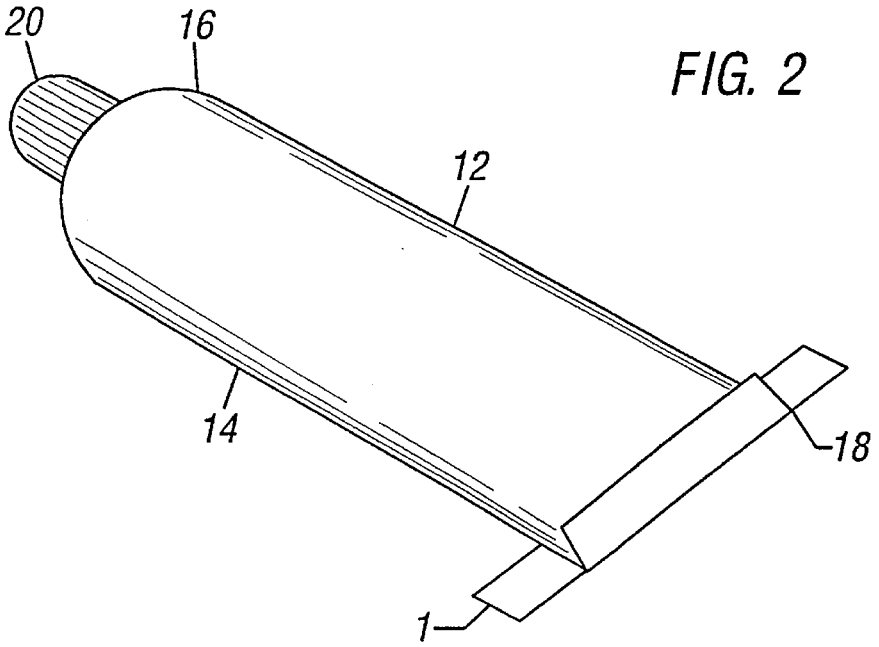
FIG. 2 is a top view showing the fastener positioned at the second end of the tube.
Figure 3:
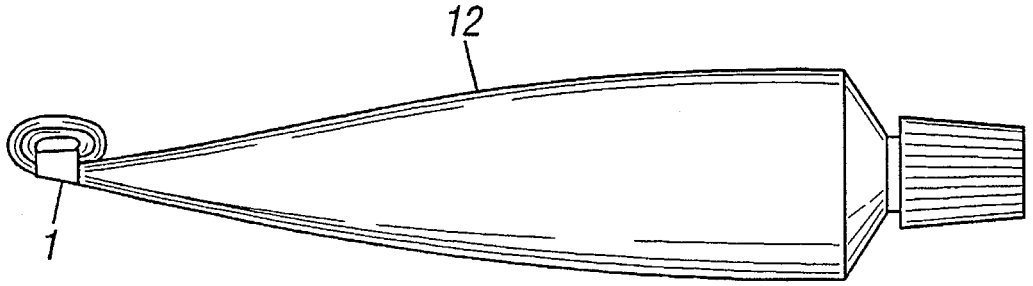
FIG. 3 is a side view showing the fastener in use.

In another embodiment of the invention there is provided an apparatus comprising a collapsible tube 12 and a fastener 1 as described previously. As illustrated in FIGS. 2 and 3, the tube 12 has an elongated flexible, tubular body 14 having a first end 16 and a second end 18. The first end 16 has an opening 20 and the second end 18 is closed. The second end 18 of the collapsible tube 12 is closely received by the fastener 1. The creasable strip portion 2 is of adequate length and strength to be folded over the collapsible tube 12 and hold it in a rolled up position.

In another embodiment of the invention, there is provided a method for dispensing the contents of a collapsible tube 12. The tube 12 has an elongated flexible, tubular body 14 with an opening 20 at one end and closed at the opposite end. The method comprises providing a collapsible tube 12 as described above and a fastener 1 as described above. In use, the fastener 1 is positioned so that the second end 18 of the collapsible tube 12 is closely received by the fastener 1 as shown in FIG. 2. The tab portion 4 is folded over the second end 18 of the tube 12 and the second end 18 of the tube 12 is rolled towards the first end 16 of the tube 12. The creasable strip portion 2 is folded over the collapsible tube 12 to hold it in a rolled up position. This embodiment of the invention may be used without a pressure sensitive adhesive on the fastener.

In yet another embodiment of the present invention, there is provided a method for attaching a fastener 1 to a collapsible tube 12. The method comprises providing a tube 12 as described previously and a fastener 1. The fastener 1 is as described previously with a pressure sensitive adhesive on a first surface 6. In use, the fastener 1 is positioned so that the second end 18 of the collapsible tube 12 is closely received by the first surface 6 of the fastener 1. The tab portion 4 is folded over the second end 18 of the tube 12 and the fastener 1 is secured to the tube 12 by pressing on the tab portion 4 to engage the pressure sensitive adhesive.

What is claimed is:

1. A fastener comprising:

a creasable strip portion having dead fold properties and a longitudinal axis, a tab portion attached to the creasable strip portion having a pressure sensitive adhesive on one surface, wherein said tab portion extends from the creasable strip portion; wherein said creasable strip portion is T-shaped, wherein said creasable strip portion is at least one and one half times as long as the tab portion, and the tab portion has a width that is at least equal to a width of the creasable strip portion, wherein the creasable strip portion is creasable across its longitudinal axis.

2. A fastener as in claim 1, wherein the creasable strip portion is elongated and has a longitudinal axis and comprises a bendable-metal member sheathed in a paper member, wherein the tab portion is formed by a portion of the paper member and extends generally normal from the longitudinal axis of the creasable strip portion.

3. A fastener as in claim 2 wherein the tab portion has a longitudinal axis positioned generally parallel to the longitudinal axis of the strip potion and is at least 3 centimeters in length and at least 1 centimeter wide and the bendable metal member comprises a metal strip.

4. A fastener as in claim 1 wherein the creasable strip portion is at least 5 centimeters in length.

5. A fastener as in claim 1, being T-shaped, wherein the creasable strip portion is at least one and one half times as long as the tab portion and the tab portion has a width that is at least equal to a width of the creasable strip portion, wherein the creasable strip portion is creasable across its longitudinal axis.

6. Apparatus comprising a collapsible tube and a fastener, wherein the tube is formed from an elongated flexible, tubular body having a first end and a second end, said first end having an opening and said second end being closed, said fastener comprising a creasable strip portion having dead fold properties, a tab portion attached to the creasable strip portion, wherein said tab portion extends from the creasable strip portion, wherein the second end of the collapsible tube is received by said fastener, the creasable strip portion being folded over the collapsible tube and holding the collapsible tube in a rolled up position;

wherein the fastener is T-shaped, and the creasable strip portion is at least one and one half times as long as the tab portion and the tab portion has a width that is at least equal to a width of the creasable strip portion, wherein the creasable strip portion is creasable across its longitudinal axis.

7. An apparatus as in claim 6 wherein the tab portion further comprises a pressure sensitive adhesive on one surface and the fastener is attached to the collapsible tube by the pressure sensitive adhesive.

8. An apparatus as in claim 6, wherein the creasable strip portion is elongated and has a longitudinal axis and comprises a bendable metal member sheathed in a paper member, wherein the tab portion is formed by a portion of the paper member and extends generally normal from the longitudinal axis of the creasable strip portion.

9. An apparatus as in claim 8, wherein the bendable metal member comprises a metal strip.

10. A method for dispensing the contents of a collapsible tube formed from an elongated flexible, tubular body having an opening at one end and being closed at an opposite end said method comprising:

providing a collapsible tube formed from an elongated flexible, tubular body having a first end and a second end, said first end having an opening and said second end being closed, providing a fastener comprising a creasable strip portion having dead fold properties, a tab portion attached to the creasable strip portion, wherein said tab portion extends from the creasable strip portion, positioning said fastener so that the second end of the collapsible tube is closely received by said fastener, folding the tab portion over the second end of the tube, rolling the second end of the tube towards the first end of the tube, folding the creasable strip portion over the collapsible tube to hold it in a rolled up position.

* * * * *